US008176576B2

(12) United States Patent
Moore et al.

(10) Patent No.: US 8,176,576 B2
(45) Date of Patent: May 15, 2012

(54) CONTAINER

(75) Inventors: Garry Moore, Ilford (GB); Christopher Bryson Garcin, London (GB)

(73) Assignee: Phoenix Product Development Limited (GB)

( * ) Notice: Subject to any disclaimer, the term of this patent is extended or adjusted under 35 U.S.C. 154(b) by 1331 days.

(21) Appl. No.: 11/575,629

(22) PCT Filed: Oct. 18, 2005

(86) PCT No.: PCT/GB2005/003996

§ 371 (c)(1),
(2), (4) Date: Mar. 20, 2007

(87) PCT Pub. No.: WO2006/043042

PCT Pub. Date: Apr. 27, 2006

(65) Prior Publication Data

US 2008/0178375 A1 Jul. 31, 2008

(30) Foreign Application Priority Data

Oct. 22, 2004 (GB) ..... 0423515.6
May 6, 2005 (GB) ..... 0509289.5

(51) Int. Cl.
*A47K 13/00* (2006.01)

(52) U.S. Cl. ..... 4/253; 4/242.1; 70/57; 70/159; 292/189; 220/318

(58) Field of Classification Search ..... 4/236, 242.1, 4/246.1, 253, 661; 70/57, 159; 292/181, 292/189, 194; 220/318, 361
See application file for complete search history.

(56) References Cited

U.S. PATENT DOCUMENTS

| | | | | |
|---|---|---|---|---|
| 3,477,070 | A * | 11/1969 | Kimber | 4/253 |
| 4,145,771 | A * | 3/1979 | Khazin | 4/253 |
| 4,648,512 | A | 3/1987 | Tarozzi et al. | |
| 4,982,863 | A | 1/1991 | Skillius | |
| 5,669,081 | A * | 9/1997 | Scherer et al. | 4/253 |
| 5,682,776 | A * | 11/1997 | Burt | 70/159 |

FOREIGN PATENT DOCUMENTS

| | | |
|---|---|---|
| CH | 663144 | 11/1987 |
| GB | 2308615 A | 2/1997 |
| IE | 914260 A1 | 6/1992 |

* cited by examiner

*Primary Examiner* — Steven J Ganey
(74) *Attorney, Agent, or Firm* — Brooks Kushman P.C.

(57) ABSTRACT

A container comprising a body (1), a lid (5) for the body (1), and a locking arrangement for securing the lid (5) to the body (1): the locking arrangement comprising a handle (23) which fits around at least a part of the periphery of the lid (5), and at least one locking device which connects the handle (23) to the lid (5) such that the lid (5) is movable by the handle (23), which is such that the locking device locks when the handle (23) is lowered with respect to the lid (5), and which is such that the lifting of the handle (23) away from the lid (5) causes the locking device (4) to unlock.

19 Claims, 4 Drawing Sheets

CONTAINER

This invention relates to a container and, more especially, this invention relates to a container that may be a sealable container or a non-sealable container.

There are many different types of known containers comprising a body and a lid for the body. Sometimes the known containers have a sealing arrangement for sealing the lid to the body. The known containers are used for a wide variety of purposes. Often the lids are difficult and inconvenient to operate.

It is an aim of the present invention to reduce the above mentioned problem.

Accordingly, in one non-limiting embodiment of the present invention there is provided a container comprising a body, a lid for the body, and a locking arrangement for securing the lid to the body: the locking arrangement comprising a handle which fits around at least a part of the periphery of the lid, and at least one locking device which connects the handle to the lid such that the lid is movable by the handle, which is such that the locking device locks when the handle is lowered with respect to the lid, and which is such that lifting of the handle away from the lid causes the locking device to unlock.

The container of the present invention is easily and conveniently operated by the handle. Simple hand operation on the handle is effective to seal and unseal the container as may be required, and also to move the lid with respect to the body.

The locking arrangement may be used with or without seals. Such unsealed embodiments would be beneficial where it is necessary to secure and un-secure the lid without sealing the contents of the container, or where visual appearance required alternative styling, or where an uninterrupted body surface finish is required, since fixing holes and protruding latching pins are not needed. Such applications may include vehicle bonnets and boots, tool-box lids, domestic appliance covers, machinery doors, storage and refuse bins, or where it is necessary to prevent the entry of animals to waste bins etc.

The container may be one in which the locking device comprises a latching clip, engaging means which is for engaging the latching clip and which is provided on the outside of the body, and a control mechanism for controlling operation of the latching clip consequent upon movement of the handle. Preferably, the engaging means is an indent. Alternatively, if desired, the engaging means may be a protruding ridge of material on the outside of the bowl instead of an indent, so that the pawl of the latching clip will still engage an inverted surface. Other alternatives include having the indent placed in the latching clip, and a static pawl on the body of the bowl. Further combinations of engaging means could include a hook and eye, a peg and hole, a catch and pin, or interspersed variations thereof on either the latching clip or bowl.

The control mechanism may comprise guide means on the latching clip, and a connecting member which runs in the guide means and which is connected to the handle. The control mechanism may be one in which the guide means is a slot, and in which the connecting member is a pin. Other types of guide means and other types of connecting member may be employed.

The lid may be pivotally connected to the body. The lid may be pivotally connected to the body by one or more pivot members. Alternatively, the lid may be completely removable from the body.

When the lid is pivotally connected to the body, the body may be a toilet bowl. The container then becomes part of a water closet that uses pneumatic means for transporting waste matter from the toilet bowl.

The sealing container may have sealing means. The sealing means may comprise a first seal and a second seal.

Generally, when the container has the sealing means, then the body may be for receiving a wide variety of solid or liquid products that need to be sealed in the body. Thus, for example, the container may be such that the body is used for receiving goods which become stale on prolonged exposure to air, for example bread, biscuits and cakes. The container may also be used for receiving liquids that lose their effectiveness on prolonged exposure to air, for example carbonated drinks. Naturally, the container will be produced to be of an appropriate shape depending upon the particular product that is to be held in the container.

An embodiment of the invention will now be described solely by way of example and with reference to the accompanying drawings in which.

Figure 1:
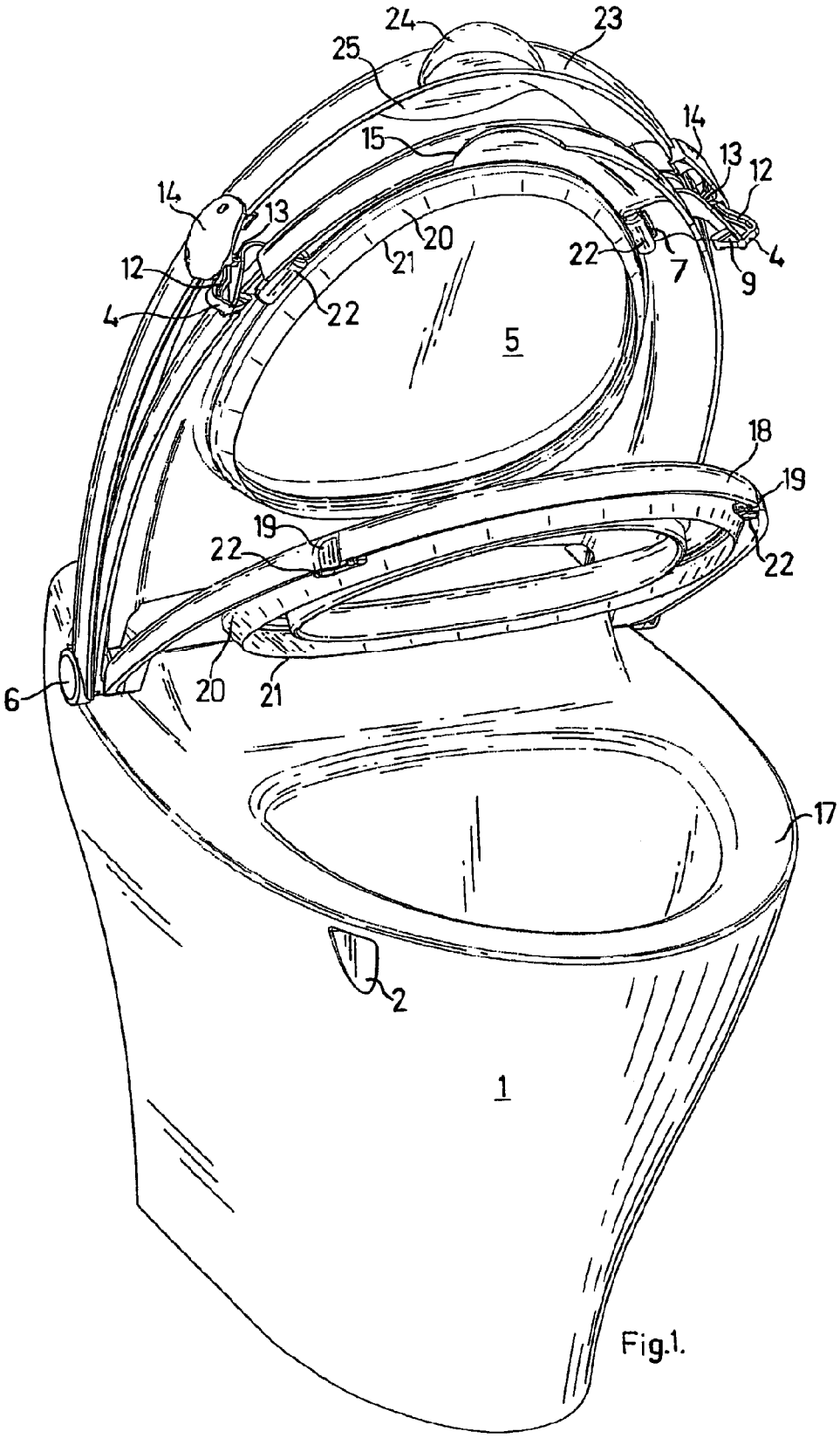
FIG. 1 is a perspective view showing a container in a nearly open position.

Referring to the drawings, there is shown a container comprising a body in the form of a toilet bowl 1, a lid 5 for the bowl 1, and a locking arrangement for locking and sealing the lid 5 to the bowl 1. The bowl 1 forms part of a water closet.

The locking arrangement comprises a handle 23 which fits around a part of the periphery of the lid 5. Sealing means is provided for sealing the seat 18 to the bowl 1, and for sealing the lid 5 to the seat 18. The sealing means is in the form of first and second seals 20 as will be described in more detail hereinbelow.

The container has a plurality of locking devices which connect the handle 23 to the lid 5 such that the lid 5 is movable by the handle 23. The locking devices are such that in their locked condition they cause the sealing means in the form of the first and second seal 20 to seal. The locking devices are also such that lifting of the handle 23 away from the bowl 1 causes the locking devices to unlock and thereby the sealing means to unseal. The locking devices each comprise a latching clip 4, an indent 2 in the outside of the bowl 1 for receiving the latching clip 4, and a control mechanism for controlling operation of the latching clip 4 consequent upon movement of the handle 23. The control mechanism comprises guide means in the form of a slot 12 on the latching clip 4, and a connecting member in the form of a pin 13 which runs in the slot 12 and which is connected to the handle 23.

As efforts are made to conserve water, it is becoming increasingly advantageous to transport waste matter by pneumatic means. This is particularly applicable to water closets, where a large reduction in water can be made by using compressed air to flush instead of water. A convenient way to achieve this is by providing a toilet bowl with a closable, sealable lid sufficient to allow the air inside the bowl to become pressurised and thereby to provide the means to flush and transport waste matter.

Known sealing arrangements for sealing the lid to the body require a high level of manufacturing accuracy to ensure that the components correctly engage and form an adequate seal. This required high level of accuracy is aggravated by the fact that sanitary wear is most conveniently produced in ceramic material, where a high level of dimensional accuracy is not possible due to distortion encountered in the manufacturing process. Also, with sanitary wear made of ceramic material, the brittle nature of the ceramic material limits the ability to clamp components tightly together to create an effective seal. Known attempts at overcoming these problems have provided impractical solutions that necessitate the use of non-ceramic toilet bowls, or which require a high level of user dexterity and understanding for operation. This is not convenient for mass market applications. Further, known sealing arrangements are easily compromised by contamination between the sealing surfaces, and also by seal wear.

The container shown in the drawings overcomes or reduces the above problems by providing a sealing arrangement which is simple to operate, which is able to tolerate a wide range of materials for producing the bowl 1, and which is also able to tolerate a wide range of dimensions and tolerances.

As indicated above and as will now be described in more detail, FIG. 1 shows the lid 5, the handle 23 and the seat 18 which is pivotally hinged onto the bowl 1 and which is shown in a raised position. Seals 20 are visible on the underside of the lid 5 and the seat 18. The handle 23 is pivotally connected to the lid 5. The handle 23 shares a common hinge point with the lid 5.

Figure 2:
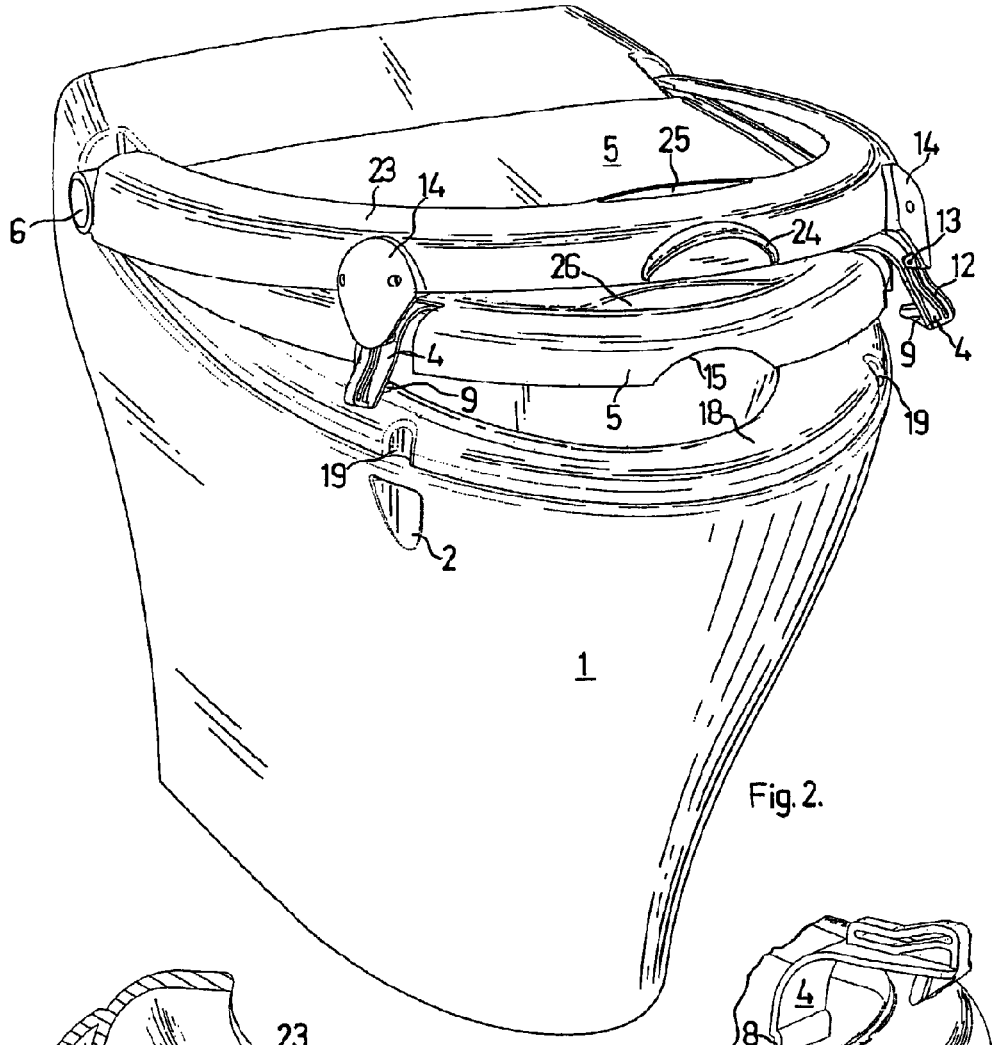
FIG. 2 shows the container of FIG. 1 in a nearly closed position.

FIG. 2 shows the seat 18 in a fully lowered position. The lid 5 is suspended from the latching clips 4, as if the handle 23 were being lowered by a user holding a grip point 24.

Figure 3:
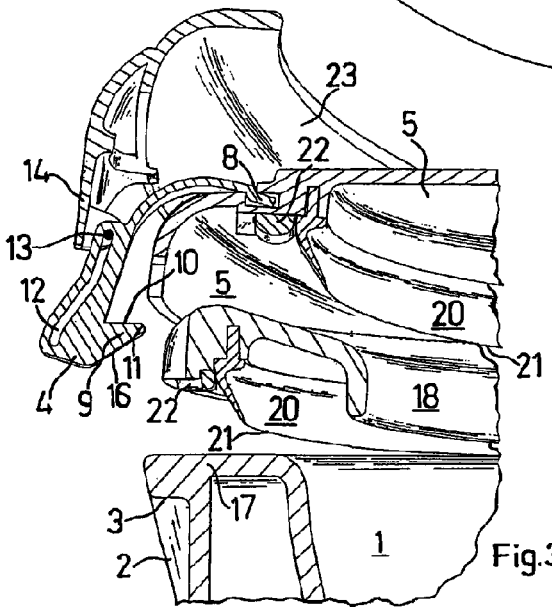
FIG. 3 is a cross section showing in more detail components of the container in the position shown in FIG. 2.

FIG. 3 is a cross section of a latching clip 4 and first and second seals 20, with the lid 5 and the seat 18 being raised to show the natural inclination of seal lips 21.

Figure 4:
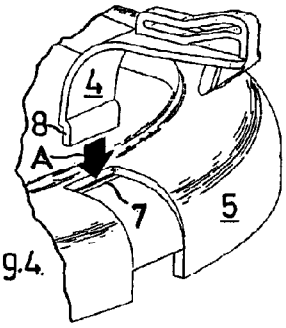
FIGS. 4 and 5 are perspective views showing an assembly procedure for assembling a locking device forming part of the container shown in FIG. 1.
Figure 5:
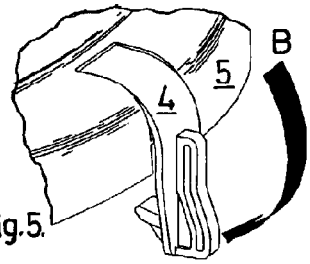

Referring to FIGS. 4 and 5, FIG. 4 shows an assembly procedure for locating a stepped tongue 8 of the latching clip 4 into a lid slot 7 in the direction of arrow "A". FIG. 5 shows an assembly procedure for securing the latching clip 4 into its captive position, once the stepped tongue 8 has engaged the lid slot 7 by lowering it in the direction of arrow "B".

Figure 6:
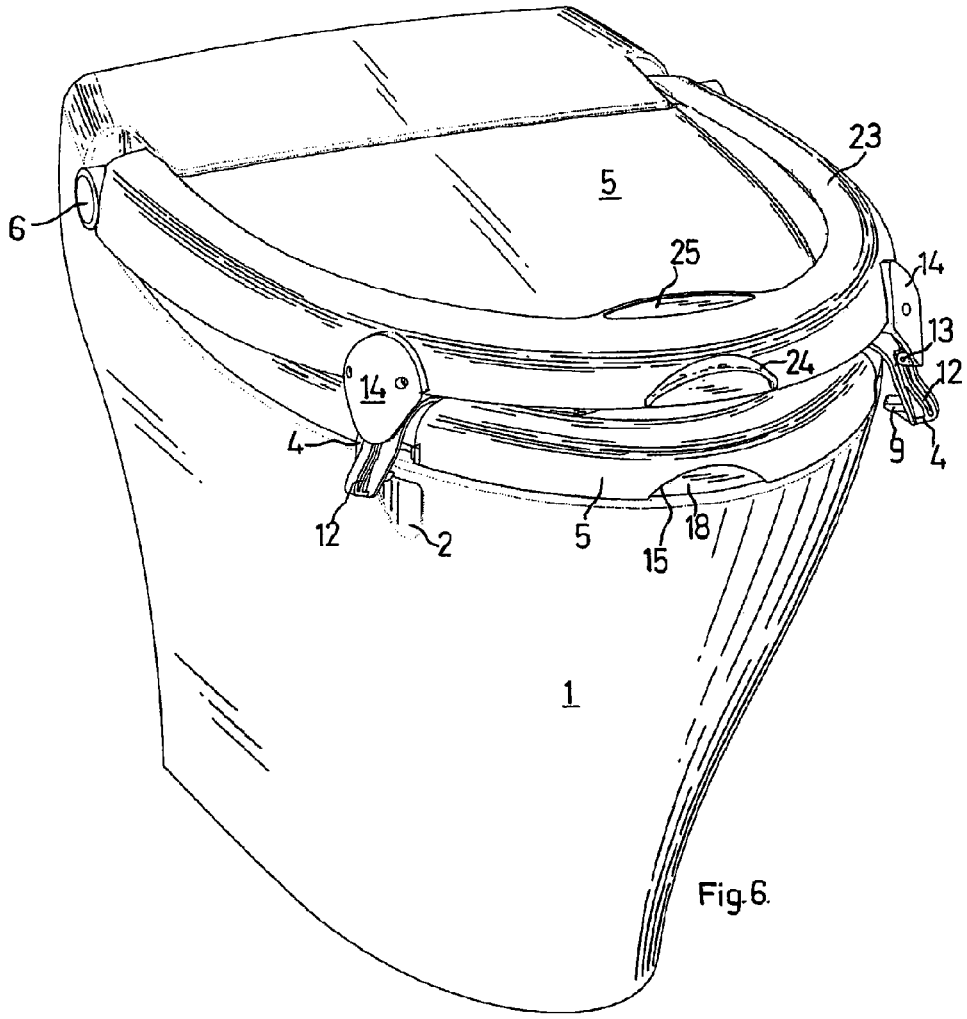
FIG. 6 shows the container of FIG. 1 in a substantially closed and sealed position.

FIG. 6 shows the lid 5 and the seat 18 unlocked in the fully lowered position. The handle 23 is not flush with the lid and, consequently, the latching clips 4 have not been moved inward to engage in the bowls indents 1.

Figure 7:
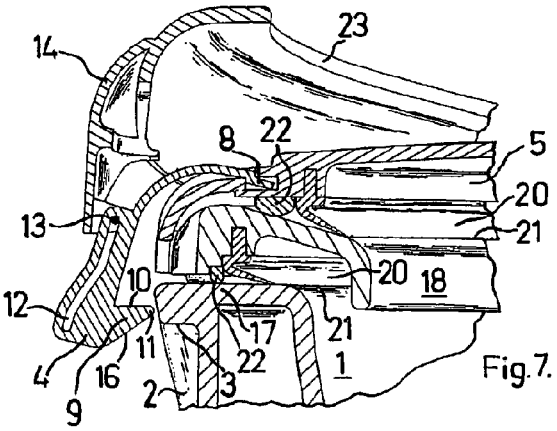
FIG. 7 is a cross section showing in more detail components of the container in the position shown in FIG. 6.

FIG. 7 is a cross section showing the clip 4 and first and second seals 20 in the position shown in FIG. 6. Buffers 22 of the seat 18 and the lid 5 are shown resting on the seat top 18 and the bowl rim 17 respectively. The seal lips 21 are lying flat against their mating surfaces.

Figure 8:
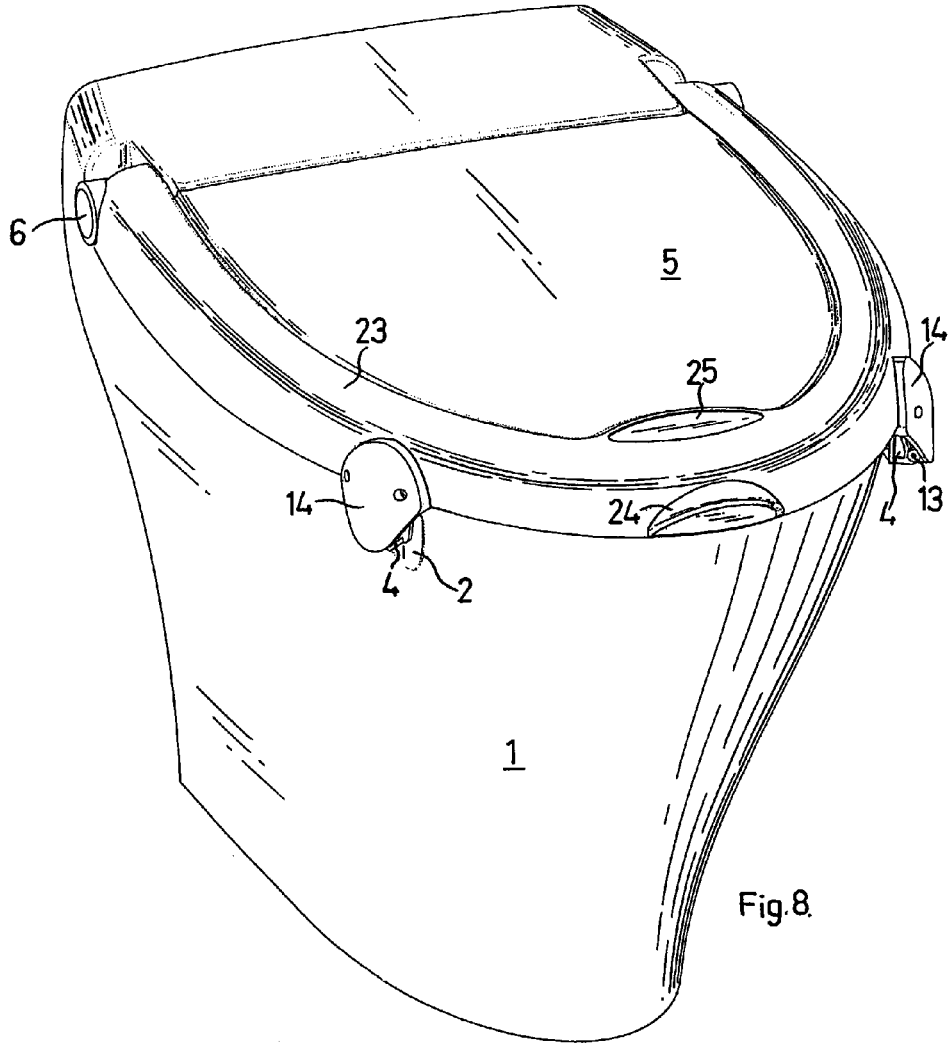
FIG. 8 is a perspective view of the container shown in FIG. 1 but in a completely closed, sealed and locked condition.

FIG. 8 shows the lid 5 and the handle 23 in a locked position. The seat 18 and the lid 5 are fully lowered as shown in FIG. 6, but the handle stop 25 is resting on a lid recess 26, and the handle 23 is flush with the lid 5. Consequently, pawls 9 of the latching clips 4 have been located in the bowl indents 2.

Figure 9:
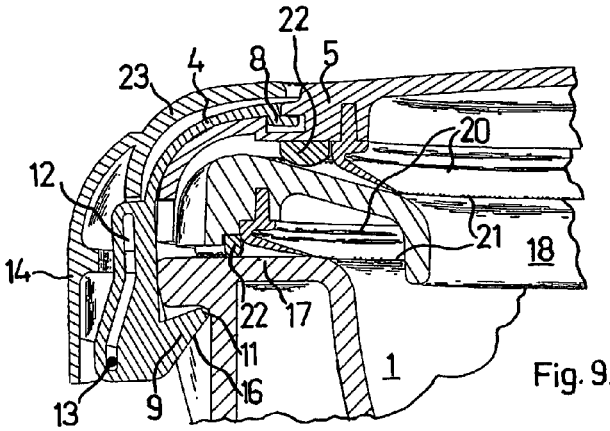
FIG. 9 is a cross section showing in more detail components of the container in the position shown in FIG. 8.

FIG. 9 is a cross section of the latching clip 4 and the seal 21 as shown in FIG. 8. The handle 23 is in a fully lowered position, whereupon the guide pin 13 has traveled along the guide slot 12 to push the latching clip 4 inward, and to make the pawl 9 engage with the inverted surface of the bowl indent 3.

Figure 10:
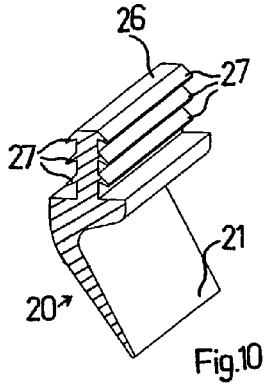
FIG. 10 is a perspective view of part of sealing means employed in the container shown in FIG. 1.

FIG. 10 is a cross sectional perspective view of one of the first and second seals 20, and shows how the seal 20 has a locating tongue 26 and barbed ridges 27.

The construction and operation of the container shown in the drawings is as follows. The bowl 1 is provided with the indents 2 which are positioned on the inverted flat surface 3 sufficient to accommodate the latching clips 4. The lid 5 is free to pivot about the hinge 6, and is provided with one or more slots 7 positioned to be over the bowl indents 2 when in the closed position.

The latching clips 4 are provided with a stepped tongue 8 at one end. The stepped tongue 8 slides into the lid slot 7 in the direction of arrow "A" when the latching clip 4 is offered in a perpendicular angle as shown in FIG. 4. However, the stepped tongue 8 forms a captive hinge when it is lowered in the direction of arrow "B" as shown in FIG. 5.

The latching clips 4 are provided with the pawl 9 at the other end in order to engage the indents 2 in the bowl 1. Each pawl 9 is designed with an angled face 10 and a rounded point of contact 11 in order to grip the indent 2 without moving outward when stressed or flexed by pressurisation of the bowl 1. It is not necessary for the pawls 9 to make contact with the bowl indent 2 when locked and while at rest because, during pressurisation, the lid 5 rises and lifts the clip 4 until the pawl 9 makes contact with the bowl indent 2. If a plurality of clips 4 is used as shown in the drawings, then the lid 5 will flex during pressurisation until all the latching clips 4 have gripped the bowl 1.

The clips 4 are further provided with an offset run of slot 12 on their outward face sufficient to contain and follow the guide pin 13 which is held captive in a handle protrusion 14. The handle 23 is positioned over and around the lid 5 as shown and is free to pivot about the hinge 6. The handle 23 is provided with one or more of the protrusions 14 that position a captive pin 13 through the slot 12. When the handle 23 is fully lowered, it has a stop 25 which comes to rest in a lid recess 26 in order to prevent over closure, and to form a flush contour with the lid 5 to visually communicate that the lid 5 is fully locked onto the bowl 1.

As the handle 23 is raised, the guide pin 13 moves up the slot 12, thus forcing the latching clips 4 to hinge in the lid slots 7 and move away from the bowl indent 2. When the guide pin 13 reaches the end of the run of slot 12, the guide pin 13 applies an upward force to the latching clip 4 to lift the lid 5. This is because the latching clip 5 is unable to return to the perpendicular angle required to release the stepped tongue 8 from the lid 5 as shown in FIG. 4.

Conversely, as the handle 23 is lowered, the weight of the lid 5 makes the lid 5 drop away from the handle 23. This causes the latching clips 4 to be moved to the outward position by the guide pins 13, where they suspend the lid 5. The lid 5 is provided with a cut-out 15 adjacent to a handle grip point 24 so that, if users inadvertently grasp the lid 5 while lowering the handle 23, the cut-out 15 allows the lid 5 to drop sufficiently to move the latching clips 4 to the unlocked position to clear a bowl rim 17 before being closed. However, the latching clips 4 are provided with an angled leading edge 16, and the components are designed to be sufficiently flexible, in order to allow the latching clips 4 to move over the bowl rim 17 to locate the indent 2 in order to assume the locked position, even if the lid 5 is forced down with the handle 23 in the locked position and the latching clips 4 are locked in their inward position.

In addition, the guide pins 13 may be removable from their captive positions, whereby the handle 23 is free to be raised independently, and the latching clips 4 may be removed from their slots 7 to aid cleaning and maintenance.

The seat 18 is free to move about the hinge 6, and is provided with one or more of the cut-outs 19 in order to provide a clearance for the pawl 9. The seat 18 is not connected to the lid 5 or the handle 14 and it is lifted independently.

The seat 18 and the lid 5 are each provided with a flexible seal 20. Each flexible seal 20 has an inward and downward facing lip 21. As the seat 18 and the lid 5 are lowered, the first and the second seals 20 make contact with the pan rim 17 and the seat 18 beneath them, and the lips 21 lay flat on their mating surfaces as shown in FIG. 7.

The lid 5 and the seat 18 are provided with one or more buffers 22 positioned to make contact with the bowl rim 17 and the seat top 18 in order to form a rest pad or pads sufficient to maintain an even sealed gap. This even sealed gap prevents the seals 20 from becoming compressed or distorted.

During operation of the container as shown in the drawings, the seal lip 21 is pushed onto its mating surface by pressurisation within the bowl 1 in order to create a hermitic seal. The characteristics of each of the first and second seals 20 are such that, as the lid 5 rises and flexes during pressurisation, the seals will move but the seal lip 21 continues to be pushed onto its mating surface to maintain an effective seal regardless of the seal position. Furthermore, pressurisation also pushes the seal lip 21 around contamination on the mating surface in order to maintain a hermitic seal sufficient for flushing. Seal wear is also minimised because the seal is not clamped or compressed.

The first and second seals 20 are each provided with a tongue 26, which fits into corresponding grooves in the lid and the seat. The tongue is provided with barbed ridges 27 along its length. The barbed ridges 27 are pushed flat against the tongue 26 as the tongue 26 is pushed into the groove in the lid 5 or the seat 18 as may be the case. The barbed ridges 27 resist the seal leaving its groove during pressurisation by gripping the sides of its groove and opening outwards to grip even harder. However, sufficient force will overcome the resistance of the barbed ridges 27 if the seal needs to be removed for maintenance.

The container shown in the present drawings has the following advantages.

1. One-handed operation is possible. Lifting the handle 23 automatically releases the latching clips 4 by moving them outwards and raises the lid 5 in one action. Lowering the handle 23 automatically closes the lid 5 and locks the lid 5 in position.
2. The lid 5 can flex away from the bowl 1 during pressurisation, but the seal lip is continually pushed onto its mating surface by the air pressure to create a hermetic seal. Any gaps between the seal and the bowl 1 caused by a distorted or damaged bowl 1 are sealed during pressurisation. The seal lip also envelops any contamination or debris that may have fallen in the path of the seal during use.
3. The latching clips 4 do not need to be clamped in place or even make contact with the bowl 1 to form an effective seal. As pressurisation occurs, the lid 5 lifts the latching clips 4 until they make contact, the lid 5 flexing until all the latching clips 4 have engaged, thus making the sealing arrangements self-adjusting. This feature is especially useful where distortion is present in a ceramic bowl 1 and/or where tolerances vary. Therefore, matching the lid and bowl components is not required, and acceptable manufacturing tolerances are increased.
4. Users do not have to touch a possibly contaminated lid 5. The handle 23 provides a convenient point of contact away from potential contaminants.
5. The handle 23 will not lay flush with the lid 5 if the latching clips 4 have not been engaged in the bowl indents 2. This provides a clear visual communication to a user that the lid 5 is not locked.
6. The seals are provided with barbed ridges along their location tongue to provide a push-fit into the lid 5 and seat seal groove. This allows easy assembly and easy replacement, and eliminates the need for undercuts in the lid 5 and the seat 18, thereby avoiding manufacturing difficulties.
7. Because the container does not require the provision of fixing holes or protruding latch pins to engage with the lid, the mating surface remains uninterrupted to improve cleaning, comfort and visual appeal.

It is to be appreciated that the embodiment of the invention described above with reference to the accompanying drawings has been given by way of example only and that modifications may be effected. Thus, for example, the container may be another type of container for a non-sanitary ware application. Generally, the container may be any container where a lid is required to be securely locked and sealed onto a body. With some containers, only one of the locking devices may be appropriate rather than two or more of the locking devices. In the drawings, the hinges may be located at the sides of the bowl in order to reduce the chances of soiling during use. The hinges may alternatively be located internally on the pan rim, or at other convenient places. The latching clip may not be provided with a hinge point as shown in FIGS. 3 and 4, but may be rigidly fixed to the lid and constructed from springy, flexible material sufficient to allow the clip to bend in and spring out as the handle applies upward and downward pressure. The seals may be of the compression type. For some containers, the seals may be omitted.

The invention claimed is:

1. A container comprising a toilet bowl body, a lid for the body, and a locking arrangement for securing the lid to the body: the locking arrangement comprising a handle which fits around at least a part of the periphery of the lid, and at least one locking device which connects the handle to the lid such that the lid is moveably liftable by the handle, which is such that the locking device locks when the handle is lowered with respect to the lid, and which is such that lifting of the handle away from the lid causes the locking device to unlock.

2. A container according to claim 1 in which the locking device comprises a latching clip, engaging means which is for engaging the latching clip and which is provided on the outside of the body, and a control mechanism for controlling the operation of the latching clip consequent upon movement of the handle.

3. A container according to claim 2 in which the engaging means is an indent.

4. A container according to claim 3 in which the control mechanism comprises guide means on the latching clip, and a connecting member which runs in the guide means and which is connected to the handle.

5. A container according to claim 4 in which the guide means is a slot, and which the connecting member is a pin.

6. A container according to claim 3 in which the lid is pivotally connected to the body.

7. A container according to claim 3 and including sealing means.

8. A container according to claim 2 in which the control mechanism comprises guide means on the latching clip, and a connecting member which runs in the guide means and which is connected to the handle.

9. A container according to claim 8 in which the guide means is a slot, and which the connecting member is a pin.

10. A container according to claim 9 in which the lid is pivotally connected to the body.

11. A container according to claim 9 and including sealing means.

12. A container according to claim 8 in which the lid is pivotally connected to the body.

13. A container according to claim 8 and including sealing means.

14. A container according to claim 2 in which the lid is pivotally connected to the body.

15. A container according to claim 2 and including sealing means.

16. A container according to claim 1 in which the lid is pivotally connected to the body.

17. A container according to claim 16 and including sealing means.

18. A container according to claim 1 and including sealing means.

19. A container according to claim 18 in which the sealing means comprises a first seal and a second seal.

* * * * *